US012527363B2

(12) United States Patent
Arena

(10) Patent No.: US 12,527,363 B2
(45) Date of Patent: Jan. 20, 2026

(54) BOTTOM-BAND-FREE BRASSIERE

(71) Applicant: Leslie Arena, Mount Laurel, NJ (US)

(72) Inventor: Leslie Arena, Mount Laurel, NJ (US)

( * ) Notice: Subject to any disclaimer, the term of this patent is extended or adjusted under 35 U.S.C. 154(b) by 0 days.

(21) Appl. No.: 19/013,096

(22) Filed: Jan. 8, 2025

(65) Prior Publication Data

US 2025/0221467 A1 Jul. 10, 2025

Related U.S. Application Data

(60) Provisional application No. 63/618,588, filed on Jan. 8, 2024.

(51) Int. Cl.
*A41C 3/00* (2006.01)

(52) U.S. Cl.
CPC ..... *A41C 3/0014* (2013.01)

(58) Field of Classification Search
CPC ..... A41C 3/0014
USPC ..... 450/70
See application file for complete search history.

(56) References Cited

U.S. PATENT DOCUMENTS

| | | | | |
|---|---|---|---|---|
| 2,508,580 | A * | 5/1950 | Mixon | A41C 3/0007 D2/709 |
| 5,098,330 | A * | 3/1992 | Greenberg | A41C 3/10 450/55 |
| D595,932 | S * | 7/2009 | Deal | D2/706 |
| 8,523,629 | B2 * | 9/2013 | Pundyk | A41C 3/0057 450/36 |
| 8,585,458 | B2 | 11/2013 | Armanino | 450/51 |
| 9,022,833 | B2 | 5/2015 | Deming | A41C 3/0064 |
| 10,357,065 | B2 | 7/2019 | Donlon et al. | A41C 3/0064 |
| 10,863,779 | B2 | 12/2020 | Guarnaschelli et al. | A41C 3/0064 |
| 10,918,556 | B2 | 2/2021 | Pollock | A61H 1/008 |
| 11,229,243 | B2 | 1/2022 | Lin | A41C 3/0064 |
| 2002/0121273 | A1 | 9/2002 | Nyilas | 128/99.1 |
| 2003/0057937 | A1 * | 3/2003 | Nair | H04B 17/19 324/95 |
| 2011/0237157 | A1 * | 9/2011 | Scott | A41C 3/0021 450/63 |
| 2013/0122780 | A1 | 5/2013 | McCall | A41C 3/0014 |
| 2014/0162530 | A1 * | 6/2014 | Wallace | A41C 3/08 450/32 |
| 2015/0011140 | A1 | 1/2015 | Gorski et al. | A41C 3/0064 |
| 2016/0165962 | A1 | 6/2016 | Hayes | A41C 3/0064 |
| 2019/0174840 | A1 | 6/2019 | Paulson | A41C 3/0057 |
| 2021/0346591 | A1 | 11/2021 | Wyrick | A61M 1/985 |
| 2021/0392959 | A1 * | 12/2021 | Harp | A41C 3/0028 |
| 2022/0279867 | A1 * | 9/2022 | Hanson Allen | D03D 15/56 |
| 2022/0346465 | A1 | 11/2022 | Stewart | A41C 3/0064 |

FOREIGN PATENT DOCUMENTS

| | | |
|---|---|---|
| CN | 213045207 | 4/2021 |
| CN | 213963782 | 8/2021 |
| CN | 215347103 | 12/2021 |
| CN | 217564994 | 10/2022 |
| ES | 1212763 | 5/2018 |
| TW | M595404 U | 5/2020 |
| WO | 2021/250703 | 12/2021 |

* cited by examiner

*Primary Examiner* — Gloria M Hale
(74) *Attorney, Agent, or Firm* — Licata & Tyrrell P.C.

(57) ABSTRACT

A comfortable, supportive bottom-band-free brassiere particularly useful for individuals healing from one or more surgical incisions beneath the breast is provided.

10 Claims, 5 Drawing Sheets

BOTTOM-BAND-FREE BRASSIERE

This patent application claims the benefit of priority from U.S. Provisional Application Ser. No. 63/618,588, filed Jan. 8, 2024, teachings of which are herein incorporated by reference in their entirety.

FIELD

This invention relates to a comfortable, supportive bottom-band-free brassiere. The brassiere is particularly useful for individuals healing from one or more surgical incisions beneath the breast as it provides support without pressing directly on any surgical incision areas beneath the breast.

BACKGROUND OF THE INVENTION

Immediately following breast surgeries such as, but not limited to, mastectomy, lumpectomy or breast augmentation, patients are wrapped in ace bandages and given an unstructured brassiere, also referred to herein as bra, with Velcro clasps to secure, compress, and stabilize the breasts.

As one moves past the hospital-provided bra and wrap, particularly in patients with breast cancer, the step of wearing a more conventional bra is an important one in the path to recovery and normalcy. Post mastectomy bras (e.g., from the hospital), while imperative to wear immediately following surgery, are constricting, not pretty or fashionable and do not provide a long-term solution.

While a standard bra may seem like the next obvious step, for many months or years after surgery, the area of incision is sensitive, painful and still healing. Thus, the reality is that standard bras which are bottom-banded are almost unwearable to someone recovering from breast surgery as the bottom band is positioned directly on the area of the surgical incision.

Sports bras are too tight and also have an elastic bottom-band which goes around the body and under the breast, causing pain to the incision area.

While tank tops or camisoles may be more comfortable than standard bras, they do not provide the necessary support. Similarly tube tops are unstructured and lack support.

A number of post-surgery brassiere garments have been disclosed.

U.S. Pat. No. 10,357,065 discloses a bamboo fiber post-surgery or a post breast cancer treatment brassiere garment suggested to accelerate wound healing. The bra has a connection means comprising a strap means operable to secure the brassiere garment over shoulders of the wearer, a band region to enclose a portion of a torso of the wearer to secure the brassiere garment to the wearer, and first and second adjustment means to adjustably close the band region of the brassiere garment and connect the strap means to a front region of the band region of the brassiere garment, which together compress the torso of the wearer in the region of the wearer's chest.

U.S. Pat. No. 11,229,243 discloses a therapeutic bra structure comprising a bra body, having a bra layered member, with side bra layered members disposed on both sides of the bra layered member separately, and a fastener assembly or an adhesive assembly combined with an edge of the two side bra layered members. The bra also has an elastic adjusting assembly, having two elastic adjusting layers, each having an elastic and permeable layered member, with the two elastic adjusting layers being combined and fixed to an inner side of the bra layered member and having an end adhesive assembly disposed on an outer side of the two elastic adjusting layers separately provided for a purpose of combining and positioning the bra layered member.

U.S. Patent Application Publication No. 20160165962A1 discloses a medical bra having extra base support which includes a first cup area having a first flap affixed to the first cup area at a first base of the first cup area. The medical bra also includes a second cup area having a second flap affixed to the second cup area at a second base of the second cup area. The medical bra has a first set of hooks on a first shoulder area of a wearer and a second set of hooks on a second shoulder area of the wearer. An ice pack is securable between any one of the first cup area and the first flap and the second cup area and the second flap, so that the ice pack does not need to directly touch any skin and result in an ice burn.

U.S. Patent Application Publication No. 20190174840A1 describes a sports bra designed for comfort with compression fabric and wicking fabric with internal elastic bands over and under the breast for support internally as well as a base band. While the bra is designed for exercise, there is disclosure for use as a garment to provide compression and support to the breasts of those who have recently undergone breast reductions, breast augmentations, or reconstructive surgery on their breasts due to breast cancer or other conditions. Because it encapsulates the breasts via seams rather than via underwire and provides compression and coverage over the whole breast area, it is suggested that the bra may prove effective for therapeutic use.

U.S. Patent Application Publication No. 20210346591A1 discloses a post-operative mastectomy bra useful in aiding in the recovery of a wearer after the wearer has undergone a surgical procedure. The bra has an outer shell including at least a back panel and two front panels when worn about a wearer; outer edges that are adjacent to each other; a fastening system for securing the outer edges of the front panels together, thereby securing the wearable garment about the wearer; a compression region that provides a compressive force about the wearer; straps that hold the bra about the wearer, and a tubing pocket attached to an inner surface of one of the front panels for holding a drain tube in a coiled configuration against the wearer.

U.S. Patent Application Publication No. 20220346465A1 discloses a post-surgical recovery garment configured as a bra with a right breast sling and a left breast sling, each inclusive of a cupped portion and a shoulder strap that extends from the cupped portion and is configured to go over the user's opposite shoulder. The post-surgical recovery garment is inclusive of a shoulder strap attachment that extends from an end of the shoulder strap that is farthest from the cupped portion and attaches to fastening portions located on a rear panel of the bra which extends across the user's back when worn, and a thoracic band which attaches below the back panel and below the right and left breast slings configured to go around the user's torso when worn.

In addition, U.S. Pat. No. 9,022,833 discloses a garment configured as a camisole, dress, leotard, bathing suit, tank top, T-shirt, halter-top or other style of garment for patients receiving radiation therapy or for other uses that includes an inner comfort layer extending down the torso and an outer support layer.

There is a need for brassiere options which provide adequate support and comfort and which are aesthetically pleasing to the wearer without placing pressure on the area of incision.

SUMMARY OF THE INVENTION

Accordingly, an aspect of this invention is to provide a comfortable, supportive, aesthetically appealing, bottom-band-free brassiere.

Another aspect of this invention is to provide a brassiere that places minimal pressure on tissue beneath the breasts of the wearer while still providing adequate support to the wearer.

The brassiere of this invention comprises a front portion configured to be positioned along the front torso of the wearer covering their breasts. This front portion comprises two bra cups, each bra cup having an inner and outer side and a top and bottom, which are connected to each other via their inner sides. The brassiere further comprises two wing portions, each wing portion being connected to the outer side of each bra cup and extending under each arm of the wearer and securing to each other at the wearer's back, and two shoulder straps, each strap connecting the top of the bra cup or a wrap to the corresponding wing portion or wrap at the wearer's back. The brassiere of this invention has no tight fitting bottom band or material below the bottom of the two bra cups, either directly below the cups or lower down the rib cage or torso.

Instead, the brassiere comprises a wrap extending at least across the front portion of the brassiere. In one nonlimiting embodiment, the wrap extends over top of the front portion. In one nonlimiting embodiment, the wrap extends from the front and around the wearer's torso and back. In one nonlimiting embodiment, the wrap is separate from other portions of the bra. In one nonlimiting embodiment, the wrap is connected to one or more wing portions. In one nonlimiting embodiment, the wrap is connected to the front portion. In one nonlimiting embodiment, the wrap is connected to one or more wing portions and the front portion. In one nonlimiting embodiment, the wrap is continuous with and forms the wing portions. In one nonlimiting embodiment, the wrap and cups of the brassiere are integrated as a single piece.

The brassiere of this invention is particularly useful for individuals healing from one or more surgical incisions beneath the breast as it provides support without pressing directly on any surgical incision areas beneath the breast.

DETAILED DESCRIPTION OF THE INVENTION

Figure 1:
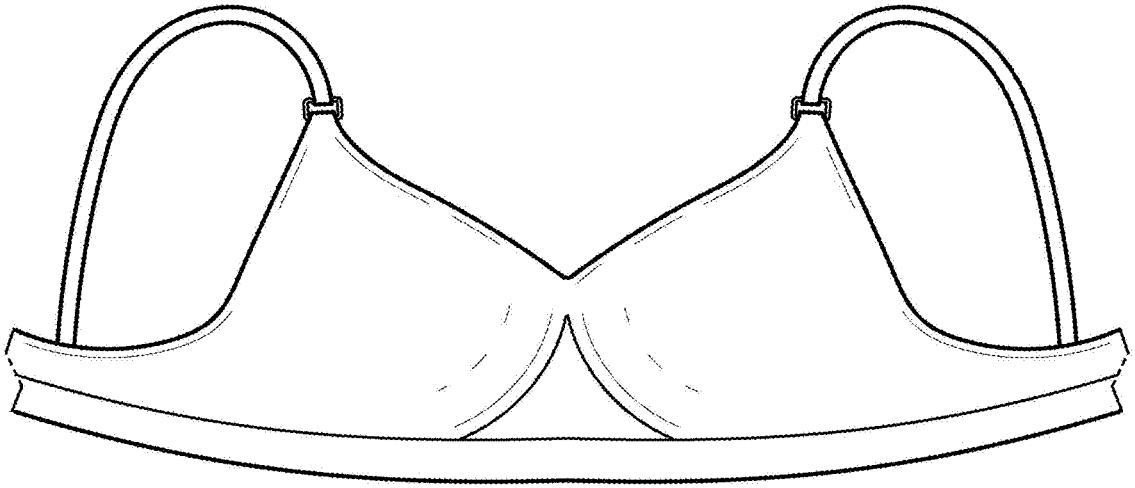
PRIOR ART FIG. 1
FIG. 1 is a diagram of a front view of a standard bra with a band at the bottom that fits below the breasts of a wearer adjacent to the torso.

Disclosed herein is a brassiere, also referred to herein as a bra, that provides sufficient support similar to standard bras such as depicted in FIG. 1, without having a bottom band or any other material below the bottom of the two bra cups.

The brassiere 1 comprises a front portion 2 configured to be positioned along the front torso of the wearer to cover their breasts. The front portion 2 comprises two bra cups 3*a* and 3*b*, each bra cup having an inner side 4, an outer side 5 and a top 6 and bottom 7, with the two bra cups 3*a* and 3*b* being connected to each other via their inner sides 4.

Bra cups may be unpadded or padded. When padded, any standard padding can be used. In addition, in some nonlimiting embodiments, boning may be added to the bra cups for additional support.

Figure 2:
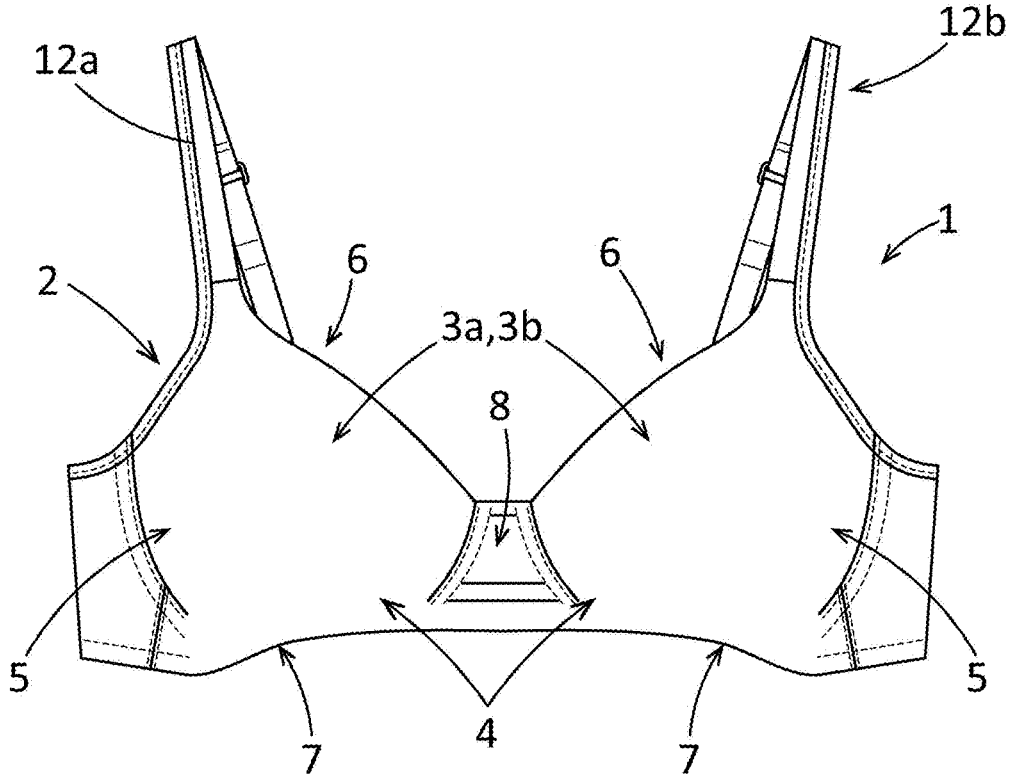
FIG. 2 is a diagram of a front view of a bra of the present invention without the front bottom-band.

In one nonlimiting embodiment, as depicted in FIG. 2, the bra cups 3*a* and 3*b* are connected at the center gore via a center front frame 8. In one nonlimiting embodiment, the center front frame comprises a polyester material. However, as will be understood by the skilled artisan upon reading this disclosure, alternative means and materials for connecting the bra cups such as, but not limited to, sewing of the cups together, connector straps and/or alternative elastic materials, can be used.

Figure 3:
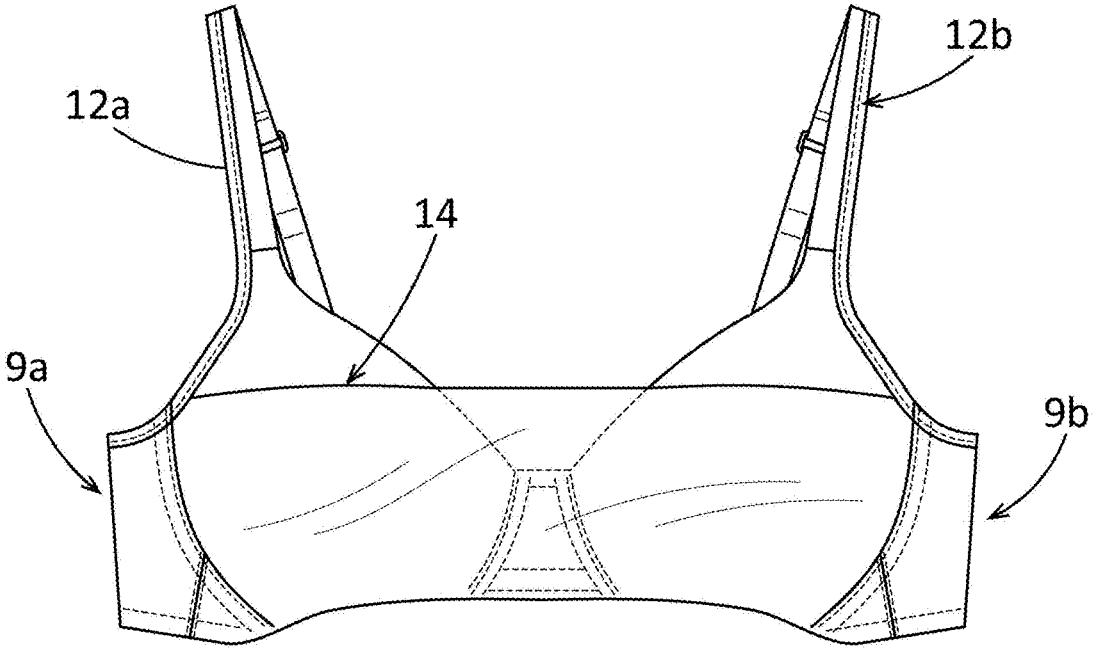
FIG. 3 is a diagram of a front view of a bra of the present invention showing a nonlimiting embodiment where the wrap is positioned over the front of the bra providing additional support.

As depicted in FIG. 3, the brassiere 1 further comprises two wing portions 9*a* and 9*b*, each wing portion being connected to the outer side 5 of each bra cup and extending under the arms of the wearer and securing to each other at the wearer's back. In one nonlimiting embodiment, the wing portions comprise a contour, shapewear knit fabric.

Figure 4:
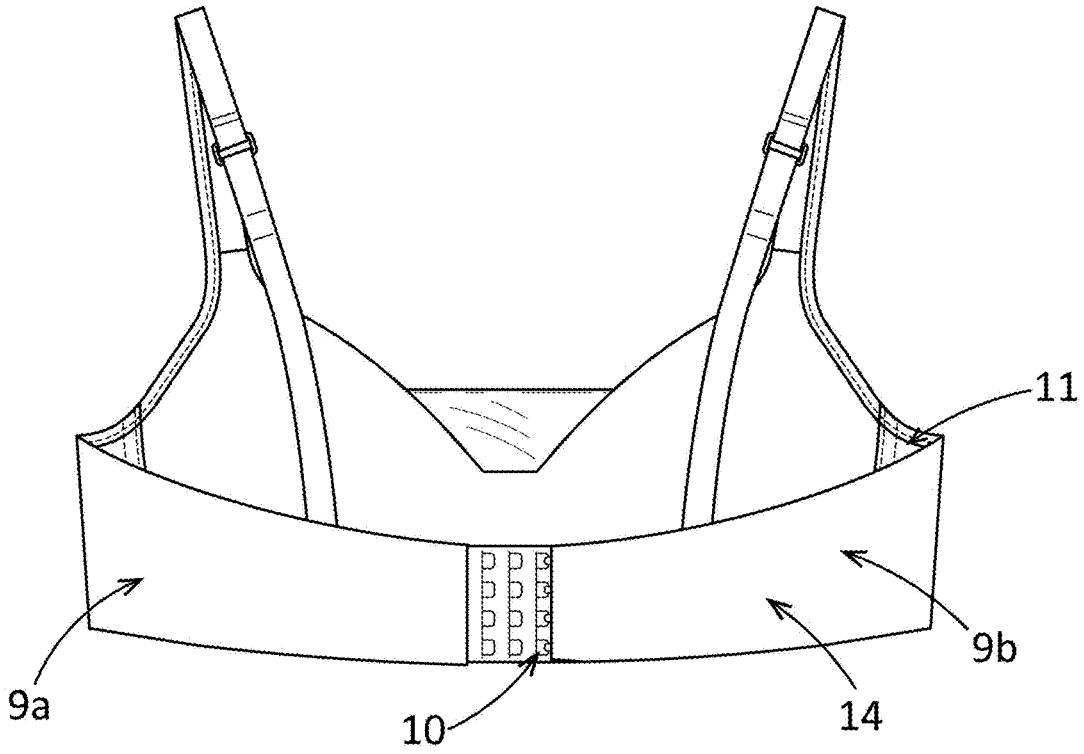
FIG. 4 is a diagram of a back view of a nonlimiting embodiment of the bra of the present invention.

In one nonlimiting embodiment, as depicted in FIG. 4 the wing portions 9*a* and 9*b* are connected via one or more clasping means 10. Figures herein depict four hook and eye closures as the clasping means as the hook and eye closure on the middle center of the bra's back is most popular. Further, depicted in the Figures is that the material holding the clasping means is soft for added comfort. However, alternative numbers of hook and eye closure, as well as alternative back closure means, bras with closures in the front and elastic bras with no closures at all are also encompassed within the scope of this invention.

In one nonlimiting embodiment, the brassiere further comprises one or more boning strips 11 in each wing portion. In one nonlimiting embodiment, the boning strip or strips are placed adjacent to the outer sides of each bra cup.

The brassiere 1 further comprises two shoulder straps 12*a* and 12*b*. In one nonlimiting embodiment, each strap connects the top 6 of the bra cup to the corresponding wing portion at the wearer's back. In one nonlimiting embodiment, the straps are sewn directly to the top of each bra cup. Alternatively, the straps may be detachable. In an alternative embodiment, the shoulder straps are connected to the top of a wrap 14.

In one nonlimiting embodiment, the straps are adjustable.

Absent from the brassiere of this invention is any tight fitting bottom band or any other material below the bottom of the two bra cups, either directly below the bra cups or lower down the rib cage or torso.

Figure 5A:
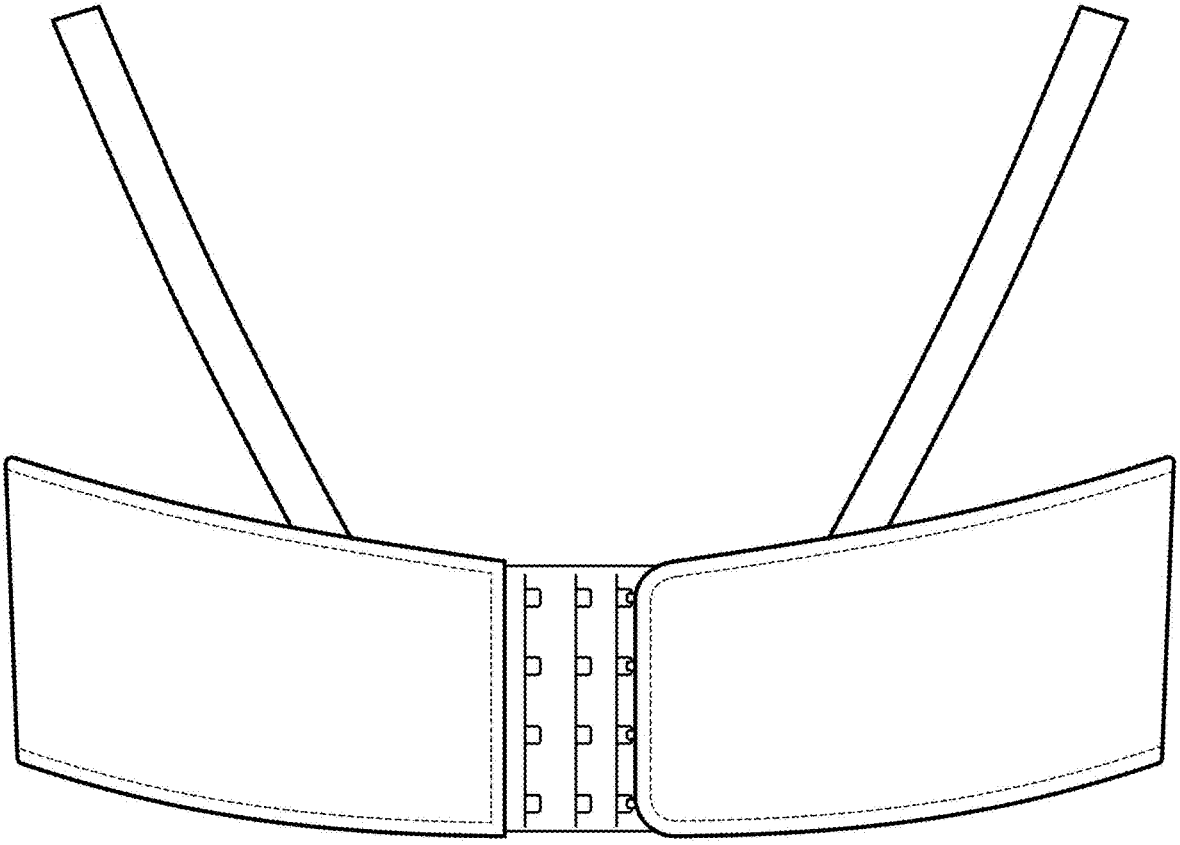
FIGS. 5A, 5B and 5C are diagrams of a nonlimiting embodiment of a bra of the present invention showing a back view (FIG. 5A), a closer view of an embodiment with optional boning (FIG. 5B), and a side view with the wrap in position (FIG. 5C).
Figure 5B:
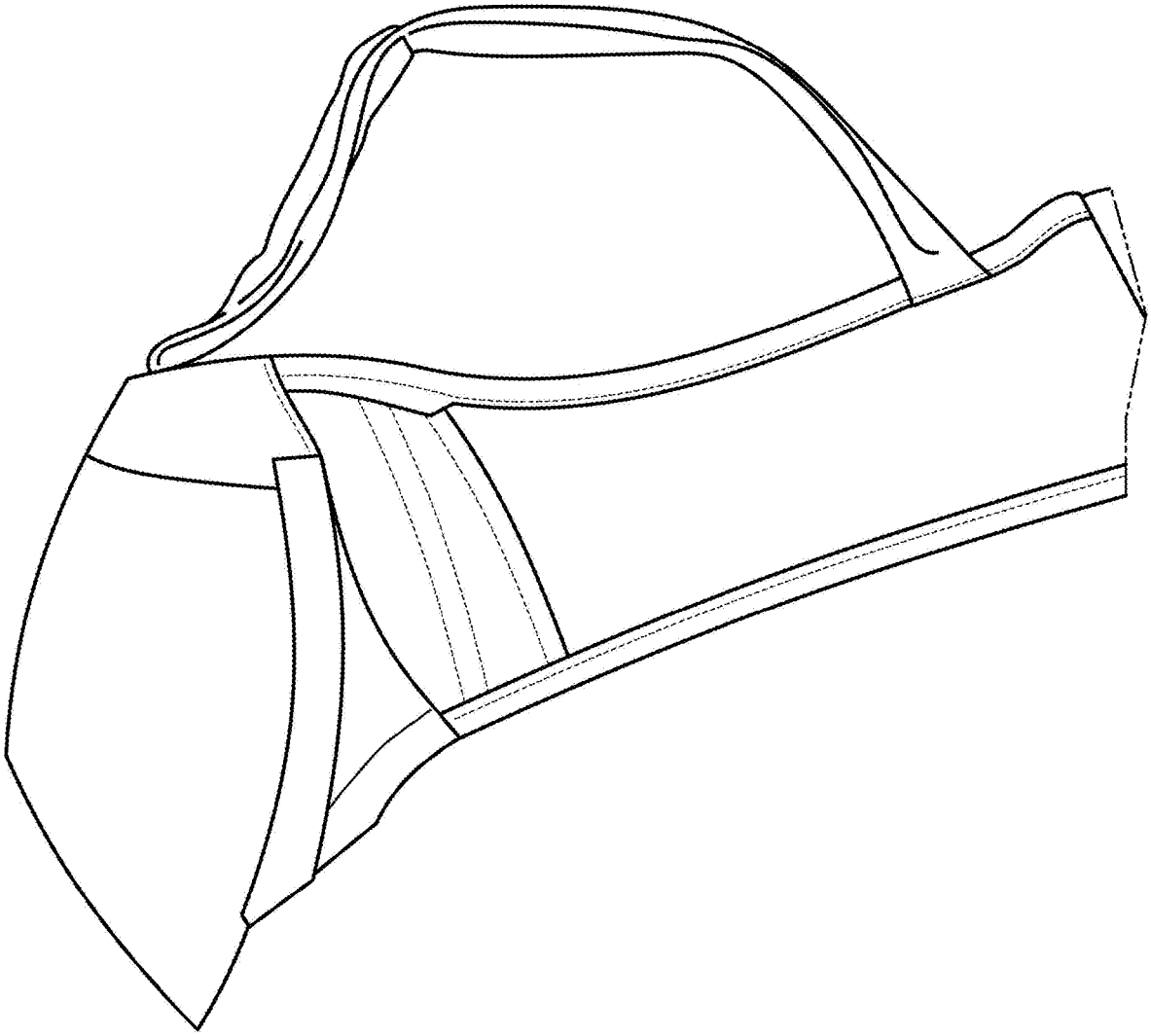
Figure 5C:
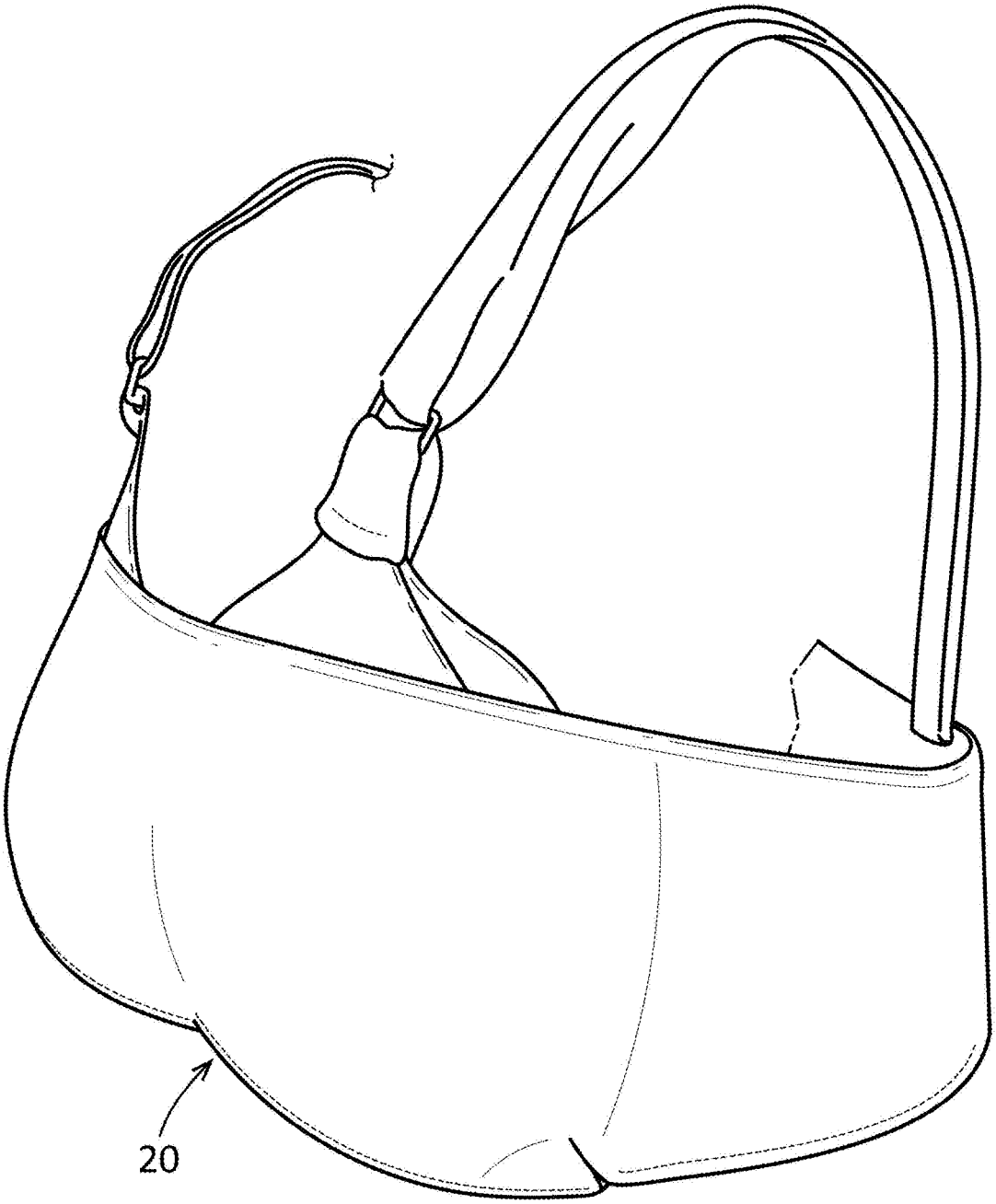

Instead, as shown in FIGS. 3, 4 and 5C, the brassiere further comprises a wrap 14 with a top and bottom extending across at least the front portion of the brassiere. In one nonlimiting embodiment, the wrap is positioned over top the front portion of the brassiere. In one nonlimiting embodiment, the wrap extends around the back. In one nonlimiting embodiment, the wrap is separate from other portions of the bra. In one nonlimiting embodiment, the wrap is connected to one or more wing portions. In one nonlimiting embodiment, the wrap is connected to the front portion. In one nonlimiting embodiment, the wrap is connected to one or more wing portions and the front portion. In one nonlimiting embodiment, the wrap is continuous with and forms the wing portions. In one nonlimiting embodiment, the wrap and cups of the brassiere are integrated as a single piece.

As shown in FIG. 5C, in one nonlimiting embodiment, the wrap has a bottom seam 20 which adds pull at the bottom of the wrap for additional support.

In one nonlimiting embodiment, the wrap and/or wing portions comprise an elastic, compression fabric. In one nonlimiting embodiment, the wrap and/or wing portions comprise a contour, shapewear knit fabric. In one nonlimiting embodiment, the contour, shapewear knit fabric comprises spandex. In one nonlimiting embodiment, the spandex content is at least 10%. In one nonlimiting embodiment, the wrap and wing portions comprise a contour, shapewear knit fabric with 81% polyester and 19% spandex.

The brassiere of this invention is particularly useful for individuals healing from one or more surgical incisions beneath the breast as it provides support without pressing directly on any surgical incision areas beneath the breast. However, as will be understood by the skilled artisan upon reading this disclosure, the brassiere of this invention may provide benefits to any wearer who finds standard bras and sports bras and the pressure they apply uncomfortable.

The invention claimed is:

1. A brassiere comprising:

(a) a front portion configured to be positioned along a front torso of a wearer to cover their breasts, the front portion comprising two bra cups, each bra cup having an inner and outer side and a top and bottom, wherein the two bra cups are connected to each other via their inner sides;

(b) two wing portions, each wing portion being connected to the outer side of each bra cup and extending under each arm of the wearer and securing to each other at the wearer's back;

(c) a wrap with a top and bottom extending across at least the front portion of the brassiere to provide additional support; and (d) two shoulder straps, each strap connecting the top of the bra cup or wrap to the corresponding wing portion or wrap at the wearer's back;

said brassiere having no bottom band or material below the bottom of the two bra cups and no bottom curve to the bra cups which places pressure beneath the breast.

2. The brassiere of claim 1 further comprising one or more boning strips in each wing portion.

3. The brassiere of claim 1 further comprising padding in the bra cups.

4. The brassiere of claim 1 wherein the wrap comprises a contour, shapewear knit fabric.

5. The brassiere of claim 4 wherein the contour, shapewear knit fabric comprises spandex.

6. The brassiere of claim 1 wherein the wing portions are connected via one or more clasping means.

7. The brassiere of claim 1 wherein the shoulder straps are adjustable.

8. The brassiere of claim 1 wherein the wrap is connected to the front and/or wing portions of the brassiere.

9. The brassiere of claim 1 wherein the wrap is continuous with and forms the wing portions.

10. The brassiere of claim 1 wherein the wrap and cups of the brassiere are integrated as a single piece.

* * * * *